US005346562A

United States Patent [19]

Batawi et al.

[11] Patent Number: 5,346,562

[45] Date of Patent: Sep. 13, 1994

[54] METHOD OF PRODUCTION OF IRON ALUMINIDE MATERIALS

[75] Inventors: Emad Batawi, Marthalen; John Peters, Winterthur, both of Switzerland

[73] Assignee: Sulzer Innotec AG, Winterthur, Switzerland

[21] Appl. No.: 120,718

[22] Filed: Sep. 13, 1993

[30] Foreign Application Priority Data

Sep. 16, 1992 [EP] European Pat. Off. ..... 92810713.5

[51] Int. Cl.[5] ..... C22C 38/06

[52] U.S. Cl. ..... 148/542; 148/546; 148/547; 148/326; 148/328

[58] Field of Search ..... 148/542, 546, 547, 557, 148/326, 328, 437; 420/62

[56] References Cited

U.S. PATENT DOCUMENTS 1,990,650 2/1935 Jaeger ..... 420/62
2,726,952 12/1955 Morgan ..... 420/77
2,768,915 10/1956 Nachman et al. ..... 148/547
3,026,197 3/1962 Schramm ..... 420/81
5,084,109 1/1992 Sikka ..... 420/77

FOREIGN PATENT DOCUMENTS 0465686 7/1990 European Pat. Off. .
90/10722 9/1990 PCT Int'l Appl. .

*Primary Examiner*—Richard O. Dean
*Assistant Examiner*—Sikyin Ip
*Attorney, Agent, or Firm*—Townsend and Townsend Khourie and Crew

[57] ABSTRACT

The method makes possible the production of iron aluminide raw materials which consist of a $Fe_3Al$-base alloy containing 18–35% Al, 3–15% Cr, 0.2–0.5% B and/or C, and altogether 0–8% of the following alloying additives: Mo, Nb, Zr, Y and/or V, as well as iron as dominant remainder. In accordance with the invention additives are added to the melt of a known alloy, from which dispersed crystallites, dispersoids, are formed which thanks to good wettability become upon solidification, embedded in the monocrystalline phase. From the solid alloy, through hot rolling at a temperature between 650° and 1000° C., a fine grain structure may be generated.

1 Claim, 1 Drawing Sheet

METHOD OF PRODUCTION OF IRON ALUMINIDE MATERIALS

BACKGROUND OF THE INVENTION

The invention is concerned with a method of production of iron aluminide materials as well as iron aluminide base alloys which occur as an end product of a method of that kind.

From the patent application WO 90/10722 it is known that certain iron aluminide base alloys are suitable as the material for the execution of industrial constructions, in particular for constructions which must exhibit at high temperature (up to 650° C.) and in an aggressive ambient (for example, $H_2S+H_2+H_2O$) a good resistance to corrosion as well as good mechanical strength. Such alloys present themselves, for example, as a cheap substitute for nickel-base alloys or high-alloy steels. Iron aluminides which consist mainly of $Fe_3Al$ are distinguished by an orderly crystalline structure with $DO_3$-symmetry: the one half of the lattice sites which form a cubical lattice are occupied by Fe atoms; the other half of the lattice sites which lie spatially centred with respect to the cubes of the first lattice, exhibit a checkerboard-like arrangement of Fe and Al atoms. The alloy on the iron aluminide base is an orderly intermetallic alloy. In what follows it is called the $Fe_3Al$ base alloy. The proportion of the aluminium in this alloy with a $DO_3$-structure exhibits a value in the range between 18 and 35% by atomic weight. Besides the $DO_3$-structure there is partially present in the $Fe_3Al$ base alloy a B2 structure (or CsCl-structure) or a disorderly spatially centred alpha-structure.

In the case of known $Fe_3Al$ base alloys with which are admixed up to 10% by atomic weight of chromium and in smaller amounts molybdenum, niobium, zirconium, yttrium, vanadium, carbon and/or boron, no low-melting-point eutectics are formed. $Fe_3Al$ base alloys exhibit a protective layer of aluminium oxide covering the surface. However, iron aluminides and many of the $Fe_3Al$ base alloys have a very poor ductility at room temperature. Only if the great brittleness of these materials can be overcome can they be employed as raw materials.

Ductility can as a rule be improved if by means of alloying additives the grain of the structure is made finer. From one publication (S. A. David et al (1989), Welding Research Sup., page 372), a $Fe_3Al$ base alloy comprising 18–35% by atomic weight of Al, 3–15% by atomic weight of Cr, 0.2–0.5% by atomic weight of at least one of B and C, 0–8% by atomic weight of at least one of Mo, Nb, Zr, Y and V, and the remainder consisting of iron is known in which an increase in the ductility at room temperature has been achieved by means of the addition of titanium diboride ($TiB_2$). In the case of welding experiments (by electron beam, arc welding), however, a hot crack formation was observed. Experiments with secondary ion mass spectrometry yielded that at the face of the crack boron and titanium occurred enriched. This discovery led to the following opinion: The titanium diboride goes into solution in the melt; it has no influence upon the formation of grain. Titanium and boron are not incorporated into the crystalline structure of the grains, therefore these constituents are to be found finally after the solidification of the $Fe_3Al$ base alloy on the interfaces of the grains. Through the influence of heat during welding the force locking between adjacent grains becomes severely reduced because of the titanium diboride (because of local lowering of the melting point at the grain boundaries), so that a heat crack formation can arise. Consequently it is advisable in spite of improvement in ductility to waive the addition of titanium diborides or substances which lead to similar phenomena.

SUMMARY OF THE INVENTION

The problem of the invention is to influence the grain formation in iron aluminide base alloys by the addition of suitable substances and the performance of suitable steps of the method, in such a way that an improved ductility at room temperature is achievable, whilst the raw material in accordance with the invention shall besides high strength at high temperature exhibit good weldability. This problem is solved by the measures characterized in that through the addition of additives to the melt of this alloy, dispersed crystallites, otherwise known as dispersoids, are formed which are satisfactorily wettable by the melt so that upon solidification the dispersoids are embedded in a monocrystalline phase, and that through hot rolling at a temperature between 650° and 1000° C. after solidification a fine grain structure is generated.

The original idea of the invention had consisted in dispersing small particles—dispersoids—in the molten $Fe_3Al$ base alloy, to act as nucleators. In the search for suitable substances a start has to be made from the following requirements:

1. The dispersoids shall be stable crystalline particles which do not dissolve in the melt at the pouring temperature. The melting point of the compound employed for the dispersoids must be considerably higher than the liquidus temperature (about 1450° C.) of the $Fe_3Al$ base alloy.
2. The dispersoids shall be thoroughly wettable, i.e., the interface energy between the crystalline particles and the melt shall be low. In order that the dispersoids may be possible nucleators there must exist at their surface lattice planes for which the lattice constant must be approximately equal to the lattice constant of $Fe_3Al$ upon solidifying (CsCl-structure), that is, about 0.4 nm.
3. The density of the dispersoids shall differ little from the density of the melt (about 6 to 6.5 g/cm$^3$) so that an inhomogeneous distribution of the dispersoids because of sedimentation is essentially absent.

In this search for possible dispersoids which satisfy the above requirements, compounds showed up of which a selection is enumerated below:

a) Substances with a $CaB_6$ structure: e.g., $B_6Ba$, $B_6Ce$, $B_6Er$, $B_6La$, $B_6Nd$ and $B_6Y$;
b) Substances with a $CaTiO_3$ structure: e.g., $AlCTi_3$, CFeIn, $CFe_3Sn$, $CInTi_3$ and $C_3Nb_4$;
c) Substances with a CsCl structure: e.g., AlPd, LaZn;
d) Substances with a $Cu_3Au$ structure: e.g., $FePd_3$, $HfPd_3$, $HfRh_3$, $InTi_3$, $LaPt_3$, $MnPt_3$, $Mn_3Pt$, $Mn_3Rh$, $Nb_3Si$, $NdPt_3$ and $Pt_3{}^3Sn$.

The choice of the dispersoids must be made on the basis of experiments.

DESCRIPTION OF THE PREFERRED EMBODIMENT

Since the dispersoids must be very small (in the region of 100 nm) it is recommendable to let these particles arise through precipitation from the melt. To do that one melts the $Fe_3Al$ based alloy in a chamber held at vacuum, then adds a protective gas to the chamber producing an atmosphere in the chamber of between 0.2 and 1.0 bar, mixing into the melt at a temperature 200°–400° K. above the base alloy melting temperature constituents of the dispersoid compound which first of all go into solution. During a holding time between 100 and 1000 seconds, after which the protective gas is pumped out of the chamber, the dissolved constituents react subsequently with one another, in doing which they form with precipitation the compound in the form of dispersoid.

An attempt to produce dispersoids in the melt of the $Fe_3Al$ base alloy was successfully performed with a compound which is not named among the substances listed above: that is, with titanium/zirconium nitride, (Ti,Zr)N. Ti and Zr (2–10 g/kg) were introduced as metal granules into the superheated melt, whilst the atomic nitrogen (N) was conveyed into the melt by means of a carrier, that is, in the form of a Fe-Cr alloy containing N. In order that the nitrogen should not evolve as gas the generation of dispersoids was performed at a pressure of 0.5 bar which was produced by means of a protective gas atmosphere of argon. During a holding time of 300 s and at 1650° C. dispersoids of (Ti,Zr)N 2–10% by volume resulted with a size distribution in which the dispersoid diameters for the most part lie between 50 and 200 nm. As starting alloy the alloy FA-129 known from the WO 90/10722 (Composition: 28% Al, 5% Cr, 0.5% Nb, 0.2% c, remainder Fe) was employed.

Through the dispersoids the melt experiences a considerable increase in its viscosity. Consequently the pouring of the melt must—in contrast to pouring of the dispersoid-free melt—be performed at a relatively high superheat (about 200K). The consequences of this is that in the case of small samples, in spite of the dispersoids the grains of the structure come out at approximately the same size as in the case of the original $Fe_3Al$ base alloy; in the case of large case pieces even far larger grains are formed. Metallurgical experiments have shown that inside the grains, thanks to good coherence of the crystalline structures, dispersoids are embedded in the monocrystalline phase. Under reshaping by hot rolling at a temperature between 650° and 1000° C. the grains occurring during solidification are reduced to finer grains by new grain boundaries breaking out at the points at which the dispersoids are embedded in the phase. By annealing the hot-rolled alloy at temperatures between 400° and 1000° C., preferably between 800° and 1,000° C. a stable high-temperature material results.

Through the introduction of the dispersoids into the $Fe_3Al$ base alloy a dispersion-hardening also takes place. This is confirmed by hardness measurements. In the case of the example mentioned with the nitride dispersoids the hardness (Vickers hardness HV, test load 1 kg) amounts to 260 after pouring, 280 after hot-rolling (900° C., 90%) and still 280 after annealing (600° C., 24 h); the corresponding values in the case of the dispersoid-free alloy are: 230, 275 and 255 respectively. Thanks to the dispersion-hardening the creep behaviour of the material is advantageously reduced.

The intermediate product of the method in accordance with the invention which is present after the solidification of the dispersoid-containing melt is explained in greater detail with the aid of drawings.

During the thermomechanical reshapings of the particle-containing alloy the dispersoids develop an important action: as has been found in the hot-rolling of dispersoid-containing cast pieces weighing 1 to 2 kg. grains arise which are 25 micrometers wide (and 0.5 mm long), whilst the corresponding reshaping in the case of a particle-free alloy leads to grains 60 micrometers wide (length likewise 0.5 mm). After the hot-rolling the grains of the material in accordance with the invention are significantly finer than those of the dispersoid-free alloy, this in spite of the fact that after the pouring the ratios have been just the other way round.

Figure 2:
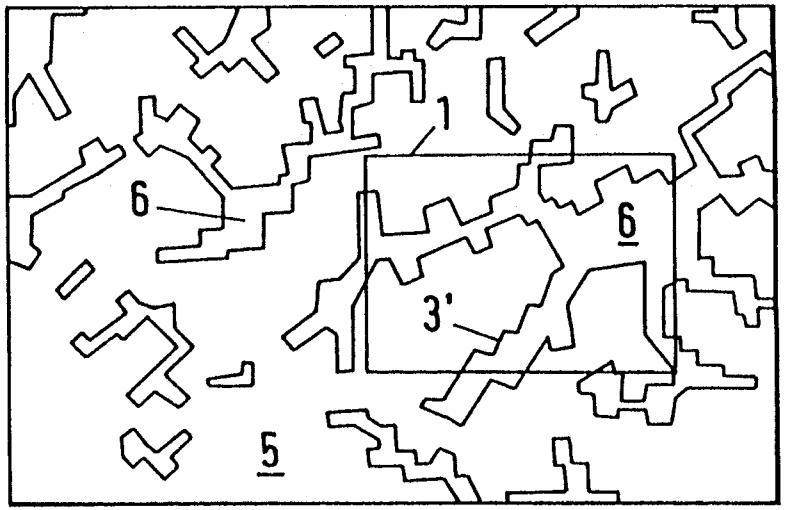
FIG. 2—a diagrammatic representation of the same sample as in FIG. 1 at a smaller enlargement (200 times)
Figure 1:
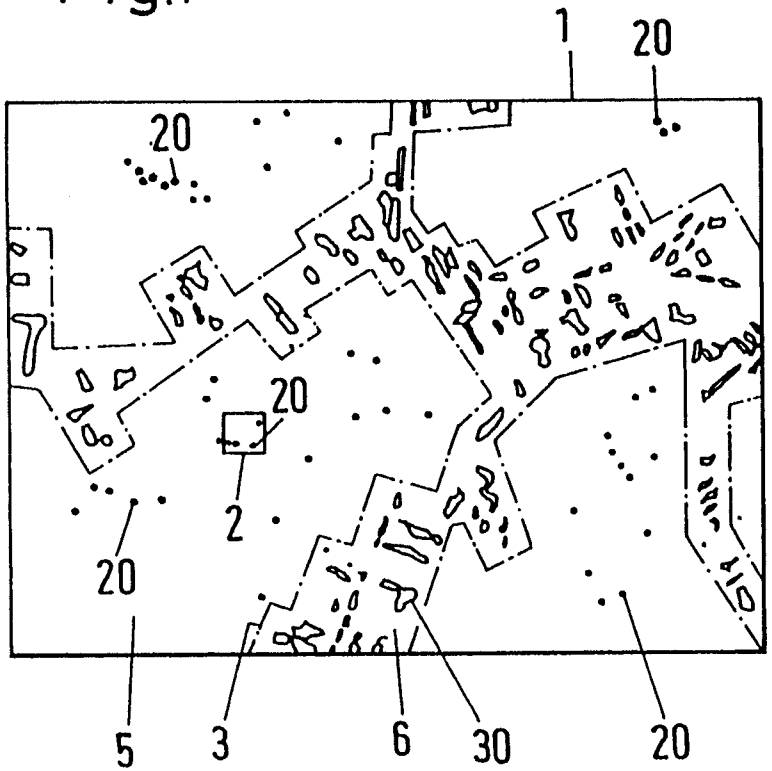
FIG. 1—a sample of an alloy in accordance with the invention (enlarged 500 times, drawn according to an image by scanning electron microscopy)

The trimmed image 1 shown in FIG. 1 may be recognized in diagrammatic form and on a smaller scale in FIG. 2. The square detail 2 in FIG. 1 is shown enlarged in FIG. 3.

Figure 3:
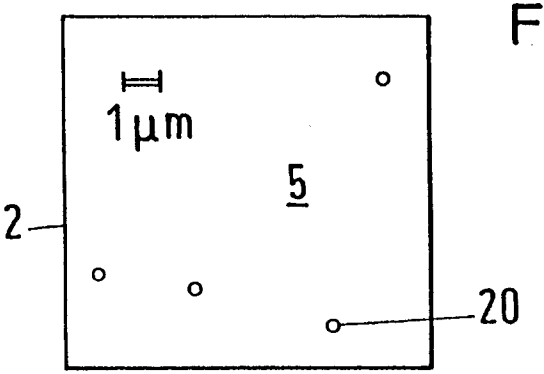
FIG. 3—a detail from the sample from FIG. 1 with dispersoids (enlarged 5,000 times).

The outline 3 drawn in FIG. 1 in straight dash-dot lines, which corresponds with the outline 3' drawn in FIG. 2 in straight solid lines, separates a monocrystalline iron aluminide phase 5 from a eutectic field 6. In the field 6 there are skeleton-like crystals 30 which are rich in iron, chromium and niobium. FIG. 2 offers a better view of the distribution of eutectic fields 6 and iron aluminide phase 5. In the phase 5 titanium/zirconium-nitride dispersoids 20 are embedded, which show in FIG. 1 as structureless dots. (Proof that the particles observed actually consist of the specified compound (Ti,Zr)N is effected by means of energy-dispersive electron beam analysis). The four crystallites 20 of the detail 2 are represented in the enlargement of FIG. 3 as small circles. The largest diameter of a dispersoid 20 amounts to about 0.3 micrometers. About the shape of the dispersoids no statement can be made on the basis of the images made by the scanning electron microscope.

We claim:

1. A method of producing iron aluminide materials from a $Fe_3Al$ base alloy comprising 18–35% by atomic weight of Al, 3–15% by atomic weight of Cr, 0.2–0.5% by atomic weight of at least one of B and C, 0–8% by atomic weight of at least one of Mo, Nb, Zr, Y and V, and a remainder consisting of iron, which comprises:

(a) melting the $Fe_3Al$ base alloy at a melting temperature in a chamber held at vacuum;

(b) adding a protective gas to the chamber producing an atmosphere in the chamber of between 0.2 and 1.0 bar;

(c) adding Ti, Zr and an Fe-Cr alloy containing N to the melted $Fe_3Al$ base alloy at a temperature 200°–400° K. above the melting temperature, forming dispersoids of (Ti,Zr)N 2–10% by volume which are satisfactorily wettable by the melted $Fe_3Al$ base alloy so that upon solidification the dispersoids embed in a monocrystalline phase;

(d) pumping the protective gas away after a holding time between 100 and 1000 seconds;

(e) solidifying the melted $Fe_3Al$ base alloy containing the dispersoids;

(f) hot rolling the solidified $Fe_3Al$ base alloy containing the dispersoids at a temperature between 650° and 1000° C.; and (g) annealing the $Fe_3Al$ base alloy containing the dispersoids at a temperature between 400° and 1000° C.

* * * * *